US005586940A

United States Patent [19]

Dosch et al.

[11] Patent Number: 5,586,940

[45] Date of Patent: Dec. 24, 1996

[54] GOLF PRACTICE APPARATUS

[76] Inventors: Thomas J. Dosch, 83 Briarhill Rd., Orchard Park, N.Y. 14127; Joseph Dosch, 325 Owasco St., Auburn, N.Y. 13021

[21] Appl. No.: 339,597

[22] Filed: Nov. 14, 1994

[51] Int. Cl.[6] ..... A63B 69/36

[52] U.S. Cl. ..... 473/140; 473/147; 473/225

[58] Field of Search ..... 473/139, 140, 473/141, 143, 146, 147, 222, 225; 330/85

[56] References Cited

U.S. PATENT DOCUMENTS

| | | | |
|---|---|---|---|
| 2,715,338 | 8/1955 | Simjian | 473/141 |
| 2,737,393 | 3/1956 | Simjian | 473/141 |
| 3,324,726 | 6/1967 | Turczynski | 73/379 |
| 3,815,922 | 6/1974 | Brainard | 273/184 B |
| 4,136,387 | 1/1979 | Sulivan et al. | 473/222 |
| 4,254,956 | 3/1981 | Rusnak | 473/225 |
| 4,342,456 | 8/1982 | Miyamae | 473/222 |
| 4,824,107 | 4/1989 | French | 273/1 GC |
| 4,830,377 | 5/1989 | Kobayashi | 273/186 A |
| 4,848,769 | 7/1989 | Bell et al. | 273/184 B |
| 4,883,271 | 11/1989 | French | 273/1 GC |
| 4,940,236 | 7/1990 | Allen | 273/183 D |
| 4,971,049 | 11/1990 | Rotariu et al. | 128/204.21 |
| 5,056,790 | 10/1991 | Russell | 273/184 B |
| 5,472,205 | 12/1995 | Bouton | 473/222 |

*Primary Examiner*—Jessica Harrison

*Attorney, Agent, or Firm*—Hodgson, Russ, Andrews, Woods & Goodyear, LLP

[57] ABSTRACT

Golf practice apparatus utilizing a tethered golf ball wherein the kinetic energy is dissipated when the ball is struck. Initial velocity vectors in the x, y, and z coordinates are derived by time integrating the respective forces over the period of time during which the kinetic energy is dissipated. From these derived velocity vectors is computed what the trajectory of the golf ball would have been if it had been untethered. Alternatively, two of the initial velocity vectors may be derived as described above and the third obtained mathematically after first deriving total initial velocity. Golf ball spin about a vertical axis may be obtained for correction to the trajectory by means of a reflective strip on the ground facing surface of the golf club head and two or more sensors for detecting the reflections from opposite ends of the strip. A circuit for time integration of the force components includes a negative feedback integrator including a feedback circuit which is open during a time when force component signals are being received thereby effecting cancellation of effects of offsets inherent in strain gages and amplifiers.

15 Claims, 10 Drawing Sheets

GOLF PRACTICE APPARATUS

The present invention relates generally to gaming apparatus and, more particularly, to golf practice apparatus wherein a tethered golf ball is struck by a golf club.

In a continuing effort to improve their game, golfers commonly utilize practice ranges or adjacent netting into which a ball is hit. Since these practices require a lot of space as well as retrieval of the balls, suggestions have been made to provide a simulated golf driving range wherein a golf ball is tethered or otherwise held captive within the system so that it is easily replaceable on the tee after each stroke. This also allows the simulated driving range to take up lesser space so that it may even be placed indoors. Examples of such apparatus and the like may be found in U.S. Pat. Nos. 3,324,726; 3,815,922; 4,824,107; 4,830,377; 4,848,769; 4,883,271; 4,940,236; and 5,056,790.

U.S. Pat. No. 3,324,726 to Turczynski discloses a simulated golf game having a ball tethered to a slide in a tube which projects a ball into a spiral track with yardage markers while the golf ball strikes an indentible background which has a picture of a typical fairway and green thereon.

U.S. Pat. No. 3,815,922 to Brainard discloses a golf shot measuring apparatus in which a golf ball is tethered to a stationary structure. Striking the golf ball causes it to travel in a generally circular path about the fixed support such that a centrifugal force vector is measured by a strain gauge or other sensor attached to the support. Then this information is used to compute the theoretical distance the golf ball would have travelled.

U.S. Pat. No. 4,848,769 to Bell et al discloses a golf game apparatus in which the striking of a golf ball restrained on a pivoted shaft generates data from which the distance and information as to hook or slice of the ball may be calculated and displayed to the golfer. Ball velocity is calculated from the voltage pulse generated by the velocity of movement of a magnet out of a coil during pivotal movement of the shaft. Twisting of the shaft causes the ball to move to one side or the other of a central sensor pad to contact sensor pads on either side thereof to indicate hook or slice.

U.S. Pat. No. 5,056,790 to Russell discloses a practice device in which a practice ball is connected by a flexible inelastic cord to a frame mounted rotatably on a base to effect rotation of the frame when the ball is struck. The frame has damping means arranged to allow the cord to extend to an extent commensurate with the striking force on the ball, and a scale provides a reading thereof.

U.S. Pat. Nos. 4,940,236 to Allen and 4,824,107 to French disclose the use of piezoelectric film-type strain gauges to measure the force at which a ball is struck.

Such simulated golf apparatus not only may be unduly complex and/or expensive but also does not provide adequate determinations of angle as well as distance.

Accordingly, it is an object of the present invention to provide golf practice apparatus which provides an accurate determination of angle and distance of a struck golf ball.

It is another object of the present invention to display information to the golfer of a diagnostic nature that will help the golfer correct errors in his or her swing.

It is another object of the present invention to provide such apparatus inexpensively.

It is a further object of the present invention to provide such apparatus so that it is not unduly complex.

It is yet another object at the present invention to provide such apparatus which is rugged, reliable, and easy to use.

In accordance with the present invention, a golf ball is tethered. The kinetic energy of the struck golf ball is dissipated. Strain gages (S.G.s) or other suitable measurement means provide measurements which enable calculation of an initial velocity vector of the golf ball in each of x, y, and z coordinates. Alternatively, two of the initial velocity vectors are determined along with the total initial velocity, and the third initial velocity vector is determined therefrom. In addition, means are provided to determine ball spin rate about a vertical axis, which produces forces causing the ball path to curve in the horizontal plane. From these measurements the trajectory of the golf ball, if it had been untethered, is computed, as well as data for diagnostic displays.

The above and other objects, features, and advantages of the present invention will be apparent in the following detailed description of the preferred embodiment thereof taken in conjunction with the accompanying drawings wherein the same reference numerals denote the same or similar parts throughout the several views.

DETAILED DESCRIPTION OF THE PREFERRED EMBODIMENT

Figure 1A:
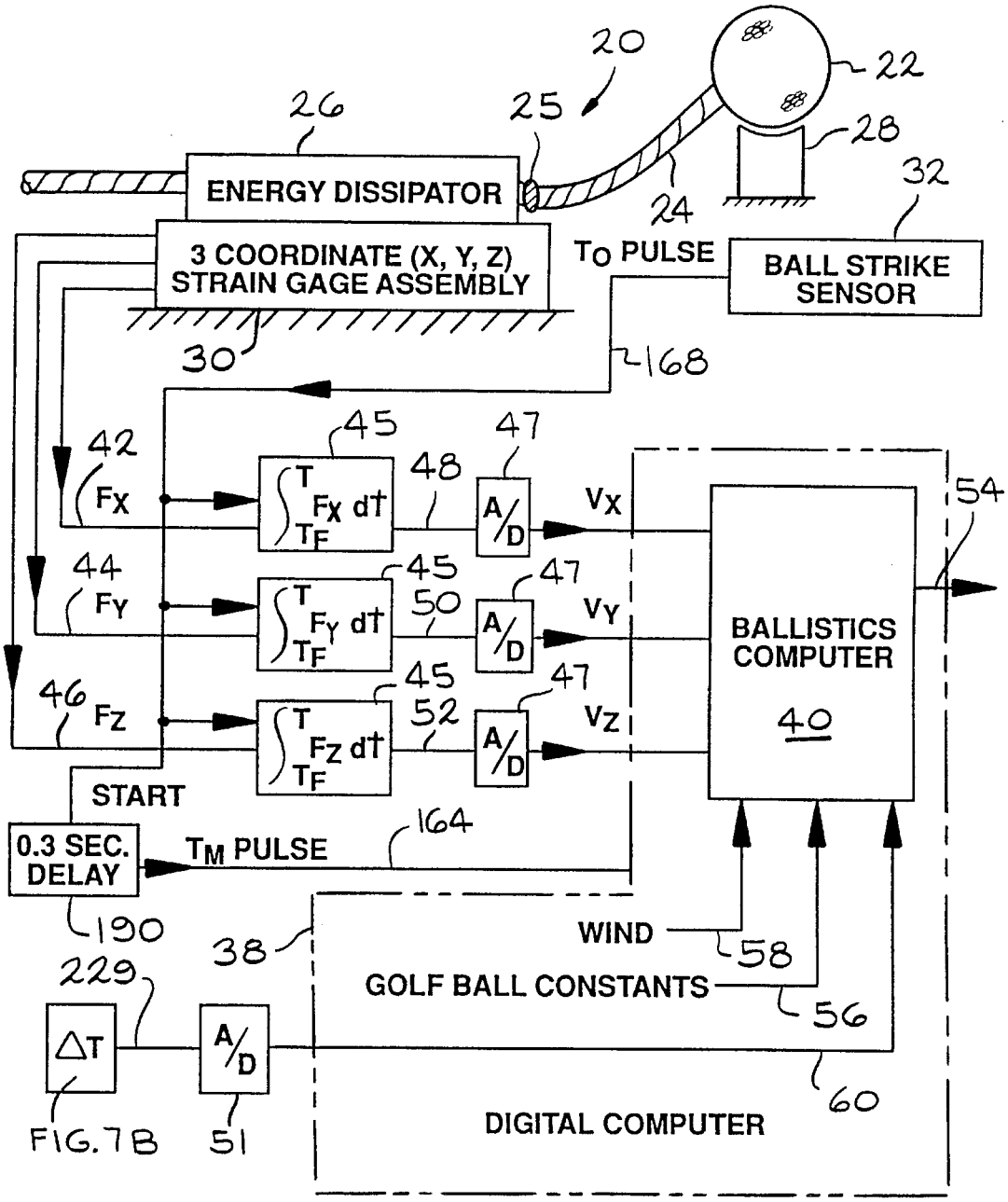
FIG. 1A is a diagrammatic view of golf practice apparatus which embodies the present invention.

Referring to FIG. 1A, there is illustrated generally at 20 golf practice apparatus wherein a golf ball 22 is attached to a tether 24 which is connected to a device 26 which is provided to dissipate or store the energy of the struck golf ball 22. For golf practice, the tethered golf ball 22, which may be mounted on a tee 28, or directly placed on artificial turf covering a floor or mechanical ground, is struck, and a calculation of what would have been the distance, direction, and flight path of the ball 22, if it had been untethered, is indicated to the golfer. Also indicated to the golfer may be (1) diagnostic data including the portion of the trajectory's lateral component due to ballspin about a horizontal axis (i.e., "hook" and "slice"), (2) the angle measuring the rotation of the club face with respect to the desired perpendicular angle between the club face and the club "swing plane" (a non-zero value causes "hook" and "slice", as discussed hereinafter with reference to FIG. 6), and (3) the angle between the vertical plane in which the club velocity vector at ball impact is located (i.e., the "swing plane") and the desired horizontal direction of ball flight, as also discussed hereinafter with reference to FIG. 6.

The tether 24 may, for example, be ⅛ inch braided nylon. The tether 24 may be knotted as by knot 25 to act as a stop when the apparatus is reset. The energy dissipation or storage means 26 is directly attached to a strain gage assembly 30 which contains 3 strain gages to measure the x, y and z components of the tether force, which enables computation of the ball's initial velocity vector in the three position coordinates x, y and z respectively. The strain gage outputs are used to compute the ball's initial velocity components by application of Newton's law of conservation of momentum, which states that along any direction coordinate the change in momentum, mV, is equal to the time integral of the force acting on the mass m. In the present instance, the change in velocity V is equal to the initial velocity, since the final velocity is zero due to the action of the tether. Therefore, the initial velocity (for any coordinate) is found by the integration of the force vectors 42, 44, and 46 (Fx, Fy, and Fz respectively), as measured by the strain gages 30, over a time interval sufficiently long to assure that the ball velocity has essentially been reduced to zero.

From these initial velocity components the ball's untethered trajectory distance and direction may be calculated. A digitized determination of ball spin about a vertical axis, as illustrated at 60, as well as golf ball constants, illustrated at 56, may be factored into the calculation, as discussed hereinafter, for a more precise determination of ball trajectory. An input of assumed wind, as illustrated at 58, may be made to add interest to a practice session. The apparatus 20 thus provides what may be called an ultra-compact golf driving range.

Figure 8:
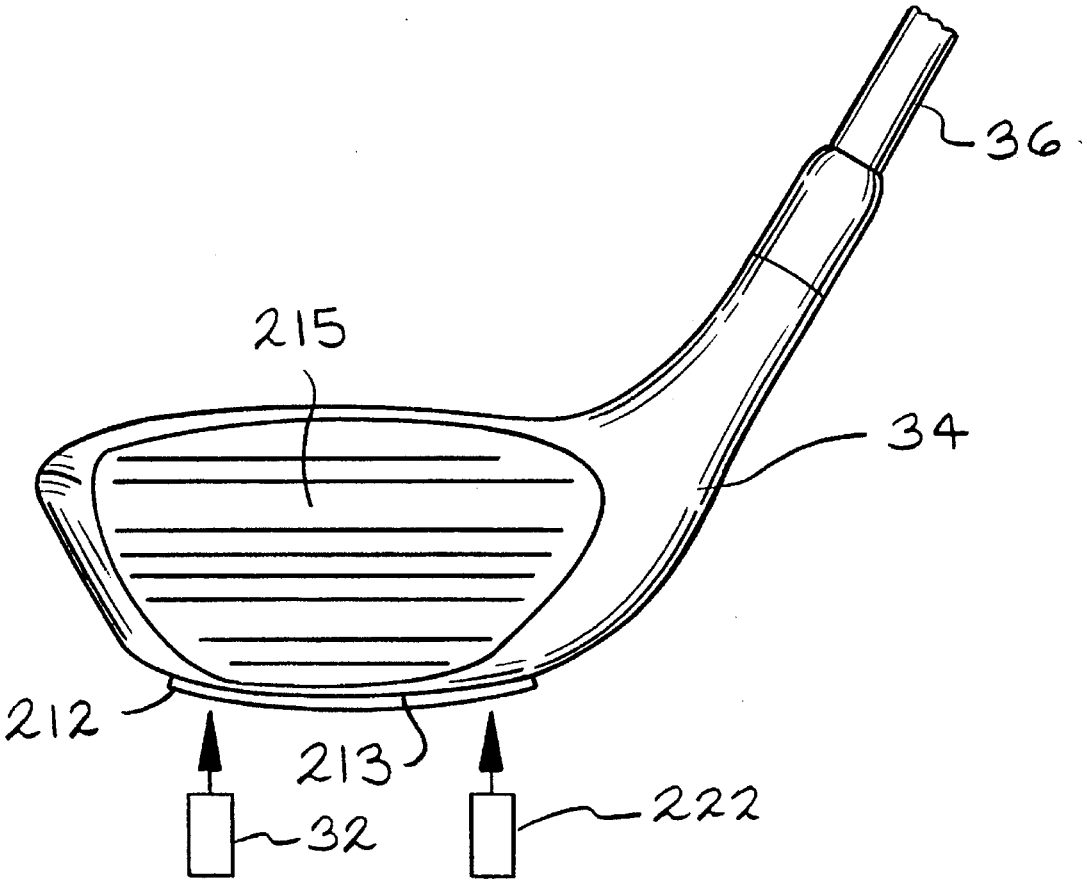
FIG. 8 is a side view of a golf club head illustrating positioning of the sensors therefor.

An optical sensor, illustrated at 32, is provided to sense the instant of time when the ball 22 is struck with the head 34 of the golf club 36, as illustrated in FIG. 8.

Figure 1B:
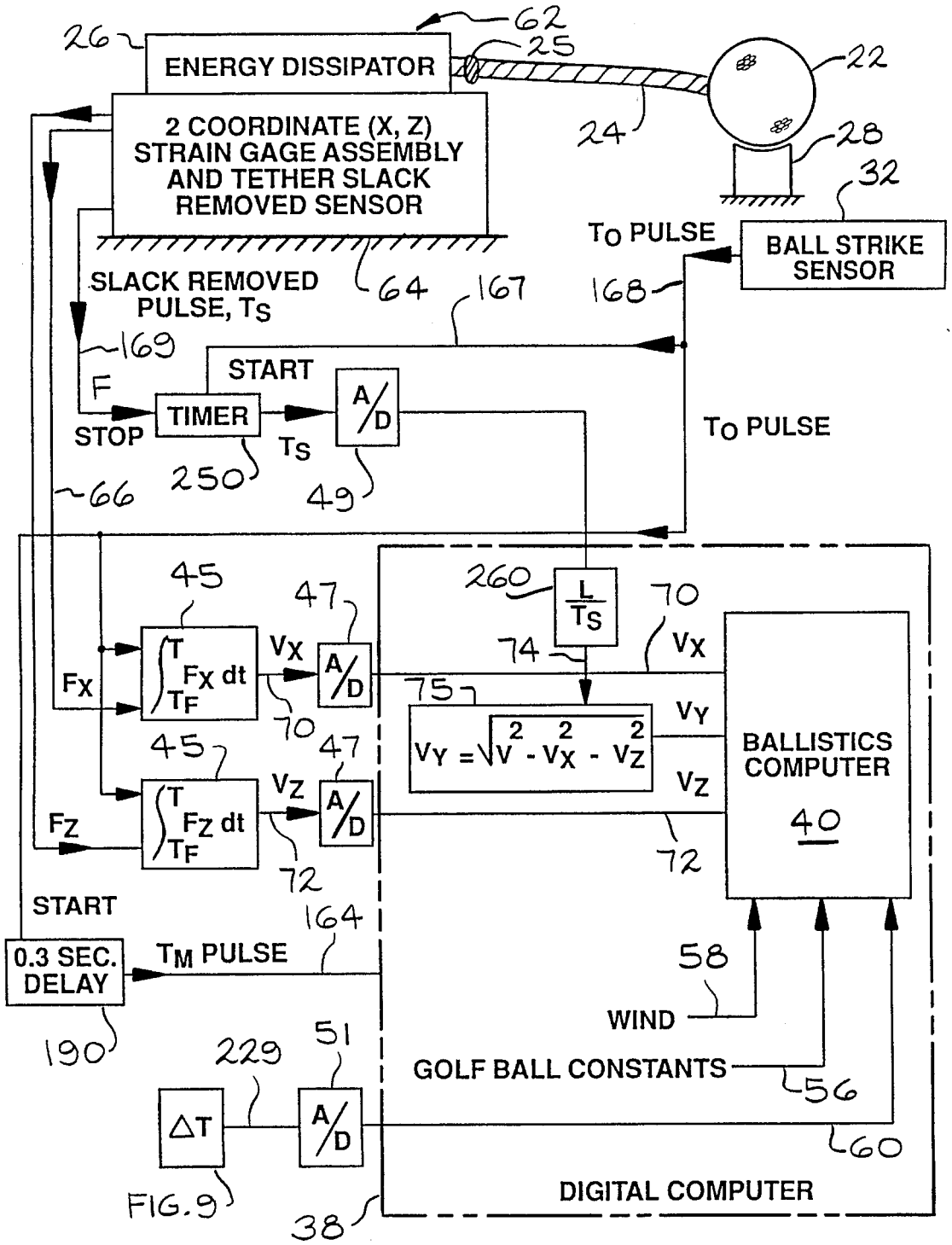
FIG. 1B is a diagrammatic view of an alternative embodiment of the present invention.

As used herein, the coordinates of ball flight x, y, and z as shown in FIGS. 1A and 1B are meant to refer to the axes of a right-handed rectangular coordinate system wherein y is the desired horizontal direction of ball flight, x is the horizontal direction perpendicular to the y direction, and z is the vertical direction. Fx, Fy, and Fz are the vectors or components of force applied by the tether in the x, y, and z directions respectively. Vx, Vy, and Vz are the vectors or components of initial velocity derived therefrom in the x, y, and z directions respectively.

Figure 3:
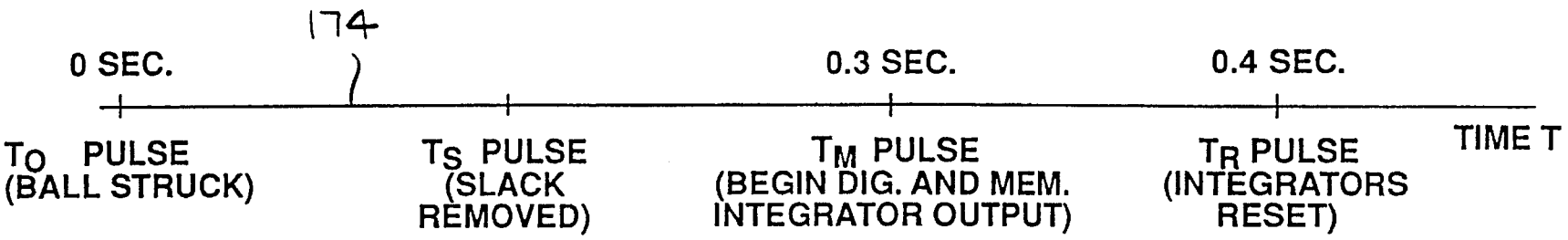
FIG. 3 is a diagrammatic illustration of timing for the apparatus.
Figure 4A:
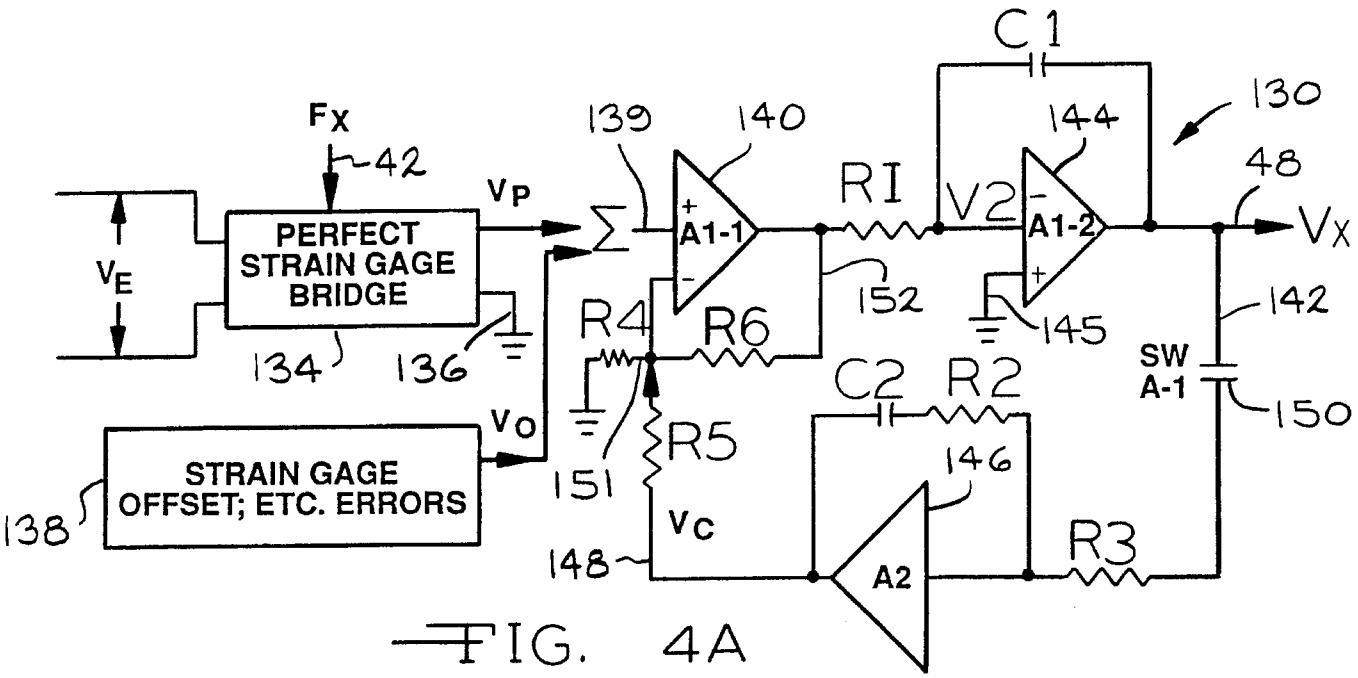
FIG. 4A is a schematic view of a velocity vector computing and offset cancellation circuit for the apparatus.

The strain gage outputs representing the force components Fx, Fy, and Fz of the strain gage assembly 30 are integrated, as illustrated at 45, in respective analog op-amp integrators, illustrated generally at 130 in FIG. 4A, to produce at the integrator outputs 48, 50, and 52 respectively voltages representing the respective ball initial velocity components Vx, Vy, and Vz. The tether 24 brings the ball to rest, and, from the law of the conservation of momentum along each axis (x, y and z), the integral of the force component is equal to the ball's initial momentum component. The momentum component, divided by golf ball mass ($m_B$), is the initial velocity component ($V_x$,$V_y$, or $V_z$). The voltages representing these respective velocity components are digitized in the A/D (analog to digital) converters 47 and fed to a digital computer 38 where they are memorized when the $T_m$ pulse 164 is received, as hereinafter discussed with reference to FIGS. 3 and 5A. A voltage, illustrated at 229, representing ball spin about a vertical axis is also digitized in an A/D converter 51 and fed to the computer 38 in the digitized form 60 where it is also memorized at the same time. The inputs on lines 56 and 58 are also memorized. Subsequently, these memorized quantities are utilized to calculate the ball trajectory and diagnostic data in the ballistics computer 40.

There is illustrated generally at 62 in FIG. 1B an alternative embodiment of the golf practice apparatus which is similar to apparatus 20 except that it includes a strain gage assembly 64 which contains only two strain gages for providing measurements of force components in two directions, i.e., Fx and Fz. These measurements are converted to velocity components Vx 70 and Vz 72, similarly as described for FIG. 1A. Vy is calculated from these components, and a "total velocity" V, illustrated at 74, is computed. This total velocity V is found by measuring the time required for the ball travel to remove the slack from the tether, as will be described for FIG. 4B. The velocity in the y direction is then calculated, as illustrated at 75, within computer 38 by the formula:

$$Vy = \sqrt{V^2 - Vx^2 - Vz^2}$$

Vz, Vx, and Vy are then inputted to the ballistics computer 40 similarly as for the embodiment of FIG. 1A.

Figure 2A:
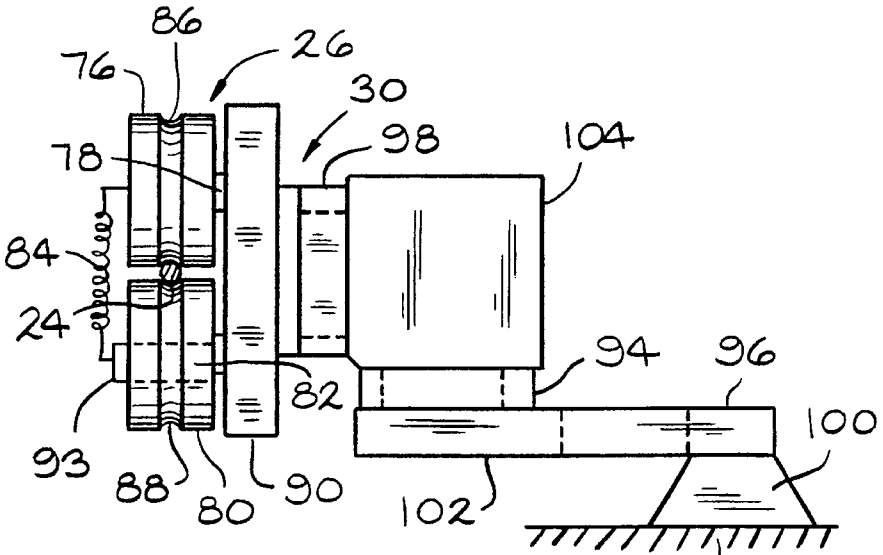
FIG. 2A is a front view of a combination strain gage assembly and energy dissipator for the apparatus of FIG. 1A.
Figure 2C:
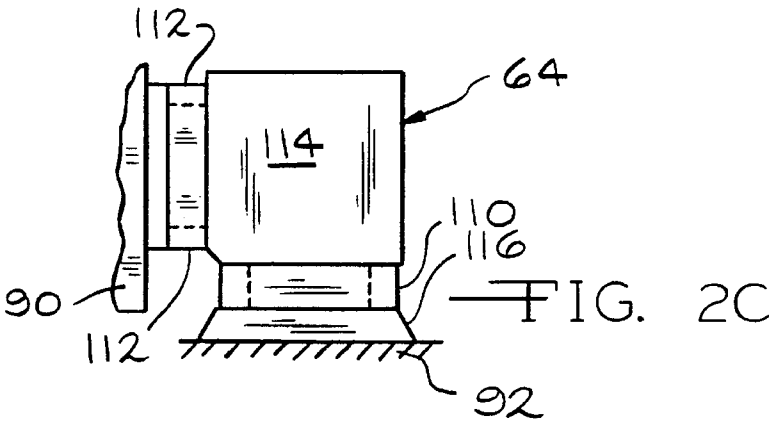
FIG. 2C is a front view of a strain gage (S. G.) assembly for the apparatus of FIG. 1B.
Figure 2B:
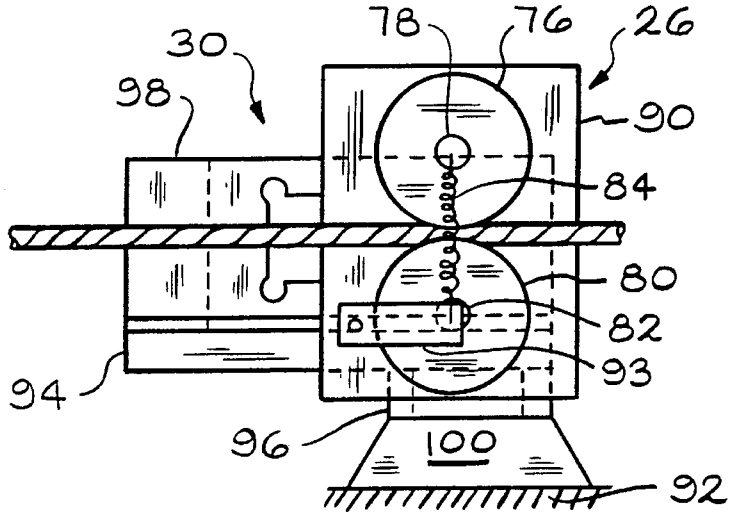
FIG. 2B is a side view thereof.

Referring to FIGS. 2A and 2B, the energy dissipation device 26 includes an upper wheel 76 on a fixed axis 78 and a lower wheel 80 on a vertically movable axis 82 to accommodate the force of spring 84 which is connected in tension between the axes of wheels 76 and 80. The wheels 76 and 80 have aligned circumferential grooves 86 and 88 respectively to accommodate the tether 24 therebetween. The wheel axes 78 and 82 are suitably mounted to a block 90, the lower axis 82 being mounted to a hinged arm 93 to allow vertical motion of the lower wheel 80. The strain gage assembly 30 connects the block 90 to the mechanical ground 92. The force of spring 84 on the tether which is disposed in wheel grooves 86 and 88 effects pinching of the tether 24 between the wheels 76 and 80 to restrain tether movement for energy dissipation. The three-coordinate strain gage assembly 30 for the embodiment of FIG. 1A has three strain gages or load cells 94, 96, and 98 suitably mounted for measuring force components in the x, y, and z directions respectively. Thus, strain gage 96 is mounted to a block 100 which is attached to the ground 92, strain gage 94 is mounted to a block 102 which is mounted to strain gage 96, and strain gage 98 is mounted to block 90 and is also mounted to a block 104 which is mounted to strain gage 94.

Referring to FIG. 2C, the two-coordinate strain gage assembly 64 for the embodiment of FIG. 1B includes two strain gages or load cells 110 and 112 for the x and z coordinates respectively which are suitably attached to block 114. Strain gage 110 is connected to ground 92 via block 116, and strain gage 112 is connected to energy dissipator 26 via block 90.

The strain gages 94, 96, 98, 110, and 112 may, for example, be thin-film load cells marketed by SMD, Inc. of Meridan Conn., U.S.A. as its series 200 double-bending beam load cells having an input standard capacity of 200 newtons (40 lb. nominal). Such a load cell has a rated output of 2.0 mV/V nominal, a bridge resistance of 4500 ohms, and provides a deflection up to about 0.20 mm (0.008 inch). Unless otherwise specified, the description hereinafter is with reference to the three-coordinate embodiment of FIG. 1A.

The strain gage assemblies 30 and 64 may be embodied otherwise than as described. For example, they may be piezoelectric strain gages, with suitable modification of the electronics.

Figure 2D:
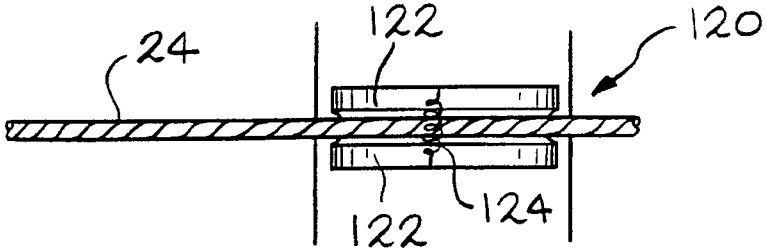
FIG. 2D is a top view of an alternative embodiment of the energy dissipator.

Referring to FIG. 2D, there is illustrated at 120 an alternative embodiment of the energy dissipator wherein a pair of plates 122 are provided to receive the tether 24 therebetween. The plates 122 as well as wheels 76 and 80 are preferably composed of copper or other material which suitably carries heat away. A suitable spring 124 is connected to the plates 122 to apply a force to "squeeze" the tether 24. The plates 122 may desirably be grooved to receive the tether 24.

While two embodiments of the energy dissipator are illustrated, it should be understood that it may be embodied otherwise. For example, the tether may be routed between plates mounted in a pair of jaws, and a bolt may be provided to tighten the jaws to provide a desired force of the plates on the tether. The plates may have grooves to receive the tether. The energy dissipator may be embodied as an energy storage device such as a spring or any combination of energy dissipator and energy storage device that is mounted on the strain gage assembly and is capable of bringing the ball velocity to zero after a short ball travel.

System timing is illustrated along time line 174 in FIG. 3. The instant at which the club contacts the ball defines t=o time; at that instant the optical sensor 32 produces the $T_o$ pulse along line 168 (FIG. 5A). For the alternative embodiment of FIG. 1B, at the instant the slack in the tether is removed the Z strain gage (or other strain gage) senses a strain and produces an output voltage which triggers generation of the $T_s$, pulse along line 182 (FIG. 5B). The timer, illustrated at 250 in FIGS. 1B and 4B, measures the interval between the $T_o$ and the $T_s$ pulse. The total ball velocity is then computed in the digital computer 38, utilizing the equation:

$$\text{velocity} = \frac{\text{distance}}{\text{time}} = \frac{L}{T_s},$$

as illustrated at 260 in FIG. 1B, where L is the distance the ball must travel to remove the slack. Typically, ball velocities might range from 24 to 240 feet/sec, and if L is 2.4 feet, the time $T_s$ may be in the range of 0.1 to 0.01 seconds.

Referring to FIGS. 1A, 1B, and 5A, a predetermined fixed time $T_m$ of perhaps 0.3 sec., chosen to be large enough to insure that the ball velocity has been reduced to essentially zero by the tether, the $T_m$ pulse is produced on line 164 by the timer 190. The $T_m$ pulse activates and causes the computer 38 to store the various input data (e.g. $T_s$, $V_x$) during the time interval from pulse $T_m$ to pulse $T_R$, which interval might typically be predetermined to be 0.1 second as is illustrated in FIG. 3. At the end of the interval of 0.1 seconds, the reset pulse $T_R$ is generated, which resets all the analog op-amp integrators 130 and flip-flops 170, 178, 227, and 236 as will be described hereinafter relative to FIGS. 4A, 4B, 5A, 5B, and 7B.

As previously noted, Newton's law equating the change in momentum of a mass to the integral of force holds independently for each of the three coordinate directions x, y, and z. For example, for the x component of force:

$$\Delta m_B V_x = m_B(\text{initial} \times \text{velocity} - \text{final} \times \text{velocity}) =$$

$$m_B(\text{initial} \times \text{velocity}) = \int_0^{Tm} F_x dt \Big),$$

where $m_B$ is the mass of the golf ball, Vx is the x component of velocity, and $F_x$ is the force acting in the x direction as measured by the x strain gage. From the above, we therefore have:

$$V_x = \frac{1}{m_B} \int_0^{Tm} F_x dt$$

The circuit for producing these computations in the x direction is shown in FIG. 4A. The timing circuits for producing $T_o$, $T_m$, and $T_R$ pulses are shown in FIGS. 5A and 5B. The computations in the y and z directions for the three-coordinate system of FIG. 1A may be obtained similarly as described for the x direction.

Figure 4B:
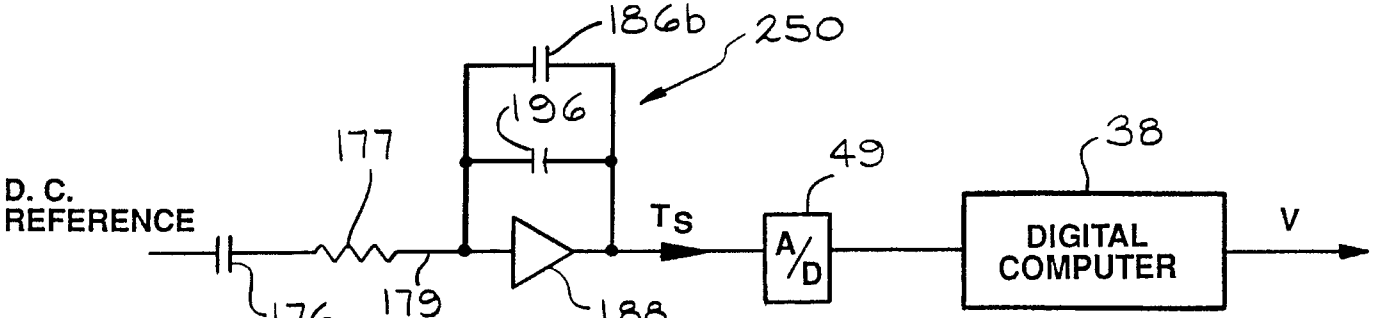
FIG. 4B is a schematic view of a circuit for computing total initial ball velocity in the embodiment of FIG. 1B.
Figure 5A:
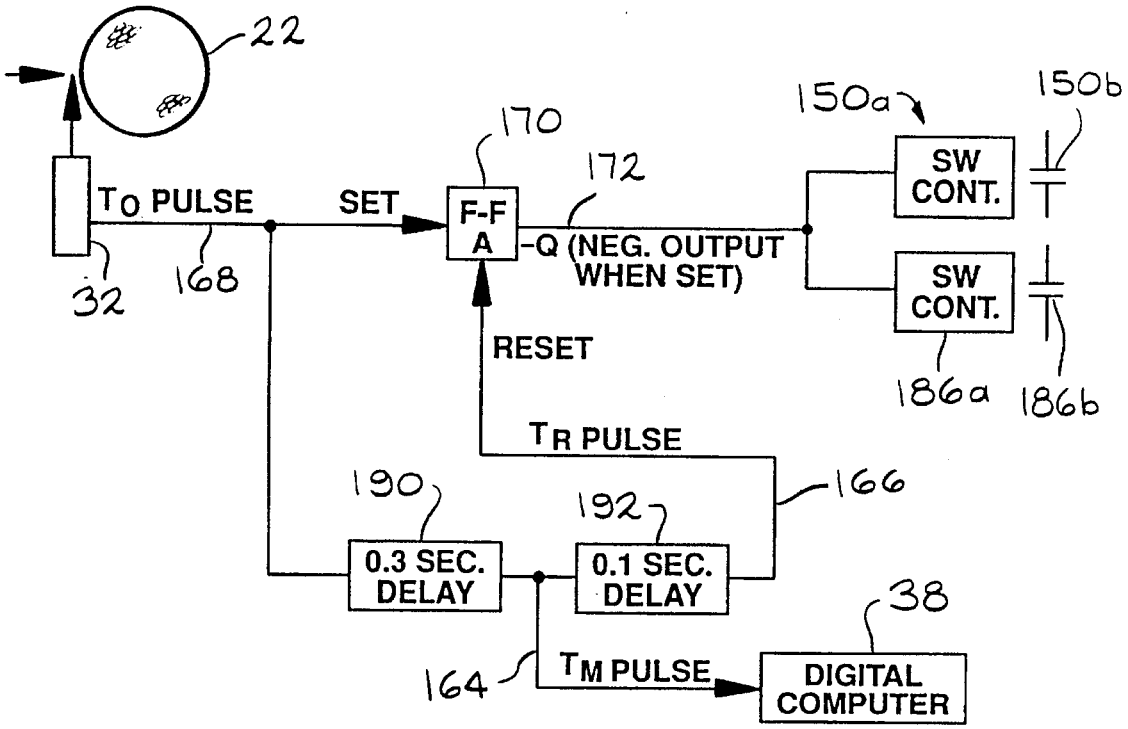
FIG. 5A is a schematic view of a timing circuit for the circuit of FIG. 4A.
Figure 5B:
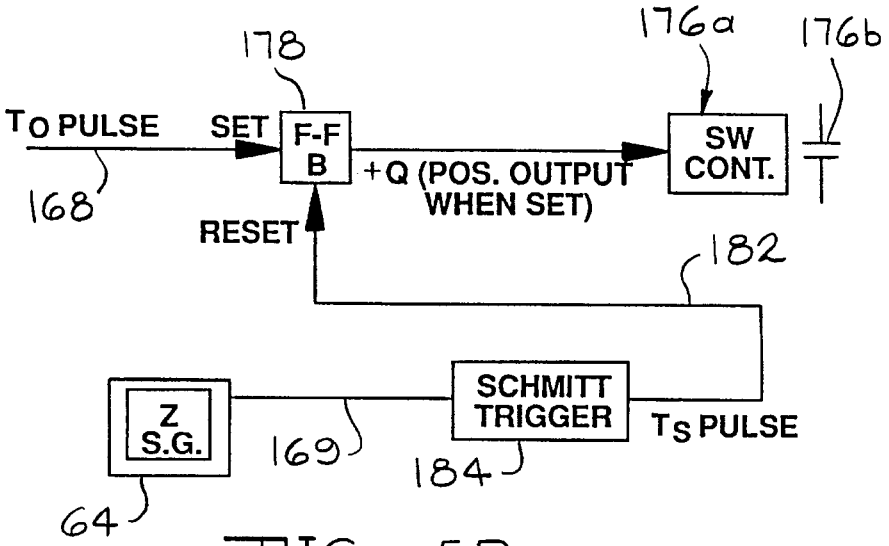
FIG. 5B is a schematic view of a timing circuit for the circuit of FIG. 4B.

For the two-coordinate system of FIG. 1B, the vectors for two of the coordinates $V_x$ and $V_z$ are computed similarly as described above for FIG. 1A, and V is computed as shown in FIG. 4B.

Referring to FIG. 4A, there is illustrated generally at 130 a circuit for computing from a measured force component (in this case, Fx) the velocity component Vx by time integrating, as illustrated at 45, the force component. The circuit values shown are for purposes of illustration only and not for purposes of limitation. Fx is imputed, as illustrated at 42, to a conventional resistive bridge strain gage sensor, illustrated at 134, which has an excitation voltage $V_E$ of perhaps 8 volts D.C. and which is grounded at 136. A voltage Vp is outputted, as commonly known to those of ordinary skill in the art to which this invention pertains. Voltage $V_p$ is inputted to the positive terminal Of op-amp (operational amplifier) 140. The combined voltage $V_o$, illustrated at 138, due to strain gage offset errors is also inputted to the positive terminal of operational amplifier (op-amp) 140. Thus, the input, illustrated at 139, to the op-amp 140 may include, in addition to Vp, a voltage $V_o$ due to offset errors that are introduced to the system. Correction for these errors will be discussed hereinafter. Amplifier 140 provides a gain of approximately 55. Its output is routed through resistor R1 to the negative terminal of op-amp integrator 144, the positive terminal of op-amp 144 being grounded, as illustrated at 145. A feedback capacitor C1 is provided with op-amp 144 to provide the integration function. The amplifier 144 integrates the output $V_p$ of the strain gage from time t=o until the $T_m$ pulse. During this period switch A-1, illustrated at 150, is open, and the combination of amplifiers 140 and 144 produce the quantity.

$$\int_0^{Tm} F_x dt.$$

The integral is effectively scaled by the factor $$\frac{1}{m_B}$$

where m is the ball's mass, which may be perhaps approximately 0.0031 slugs. For an output $V_p$ from the strain gage of 16my for a 50 pound force, the scaling at the output $V_x$from integrator 144 may be chosen to be approximately 0.02 volts/ft/sec. As previously discussed relative to FIG. 1A, output $V_x$ of op-amp integrator 144 is routed to the respective A/D converter 47 and then to the ballistics computer 40 along line 48.

The output $V_x$ is also inputted along line 142 to op-amp 146 with switch 150 and resistor R3 being in series therewith. This amplifier 146 is used primarily to compensate for the offset errors 138 as described hereinafter. It also performs the function of resetting integrator 144 to zero between golf strokes. Capacitor C2 and resistor R2, which are in series with each other, provide negative feedback around op-amp 146. The output of op-amp 146 is inputted, via line 148 which contains resistor R5, to the negative terminal of op-amp 140. Line 148 is connected to ground via line 151 having resistor R4. A feedback loop 152 for op-amp 140 contains resistor R6 for setting the gain.

The switch 150 remains closed until t=o, when the ball 22 is struck, and then remains open until $t=T_R$, at which time it closes. The output $V_x$ is digitized by the respective A/D converter 47 and memorized in the digital computer 38 between times $T_m$ and $T_R$ in accordance with principles commonly known to those of ordinary skill in the art to which this invention pertains.

The various errors 138 (offsets, thermo-electric potentials, op-amp bias, etc.) undesirably cause the input 139 to the op-amp 140 to be other than zero when the mechanical force F is zero, which would result in introduction of error into the output voltage $V_x$ if not corrected. The resulting error may be appreciable. For example, errors 138 of only 50 microvolts may result in an error of more than 10 feet/second in $V_x$ if the amplifier 146 is omitted.

The operation of op-amp 146 for eliminating this error may be described as follows. When $V_p$=0, i.e., there is no force applied, the only input to the positive terminal of op-amp 140 is then $V_0$, the offset voltage. If the feedback loop comprising op-amps 140, 144, and 146 and closed switch 150 reaches a stable steady state, the output 148 of op-amp 146 is constant. Since op-amp 146 is essentially an integrator, a constant output 148 requires that the input 142 to op-amp 146 be zero. Thus, the output $V_x$ of op-amp 144 is zero. This can only be so if the input to op-amp 144 is zero, which in turn requires that $V_c$, the output 148 of op-amp 146, be exactly compensating the offset voltage $V_o$. During the period the switch 150 remains open between $t=T_0$ (see FIG. 3) and $t=T_R$, the input to op-amp 146 is zero. Since op-amp 146 is an integrator, its output during this period remains as it was before switch 150 is opened except for the small effect of the bias currents of op-amp 146. 0p-amp 146 may be selected to be a suitably low bias current op-amp, such as the OP-80 op-amp sold by Precision Monolithics Inc., to reduce this effect to negligible proportions.

The resistor R2 in the feedback of op-amp 146 is provided to stabilize the feedback loop (since the loop contains two integrators in series, an otherwise unstable situation) while having no appreciable effect on the desired offset cancellation.

Referring to FIG. 4B, there is illustrated the use of timer 250 for computing total ball velocity V of line 74 in the embodiment of FIG. 1B. As seen in FIG. 1B, force F from the strain gage assembly 64 is inputted to timer 250 which also receives an input of the $T_o$ pulse via line 168 and branch line 167. The timer 250 provides a voltage output $T_s$, to A/D convertor 49. Since $V=L/T_s$ and is therefore related to the reciprocal of $T_s$, this output voltage is representative of the reciprocal of total velocity V. This voltage is conducted via line 74 to computer 38 for calculating $V_y$, as illustrated at 75.

The timer 250 includes op-amp 188 to which D. C. reference voltage is supplied via switch 176 and resistor 177 through line 179. Switch 176 as well as switches 150, 186, 231, and 243 (the latter three switches described hereinafter) are solid state switches such as, for example, the Motorola MC14066 switch. Each switch comprises two parts, i.e., the control circuit 176*a*, 150*a*, 186*a*, 231*a*, and 243*a* respectively and the contacts 176*b*, 150*b*, 186*b*, 231*b*, and 343*b* respectively which are closed by energizing the control circuitry. Switch 186 and feedback capacitor 196 are in parallel with op-amp 188. Switch 176 remains open and switch 186 remains closed until the $T_o$ pulse closes switch 176 and opens switch 186, as illustrated in FIGS. 5A and 5B. The reference voltage is then integrated until the $T_s$ pulse is received, as illustrated in FIG. 5B, at which time switch 176 opens. The output of op-amp 188 is therefore proportional to the time period $T_s$ and remains stored, for digitizing by A/D amplifier 47, until the reset pulse $T_R$ closes switch 186, resetting the integrator 188 to zero output. The ball total velocity is then computed as $V=L/T_s$, as illustrated at 260 in FIG. 1B, where L is the distance the ball travels to remove the slack.

The circuits for providing the $T_o$, $T_s$, $T_m$ and $T_R$ pulses of FIG. 3 are shown in FIGS. 5A and 5B, it being understood that other suitable circuitry may alternatively be employed.

Referring to FIG. 5A, the $T_o$ pulse from sensor 32 along line 168 sets flip-flop 170, which provides a negative control voltage-Q along line 172 to parallel switch controls 150*a* and 186*a* causing solid state contacts 150*b* and 186*b* respectively to be open. The contacts 150*b* and 186*b* remain open until time $t=T_R$, as illustrated by 0.3 sec. and 0.1 sec. delays 190 and 192 respectively, at which time the $T_R$ pulse on line 166 resets flip-flop 170 causing contacts 150*b* and 186*b* to close. Perhaps one tenth of a second prior to this, as illustrated at 192, line 164 routes the $T_m$ pulse to the digital computer 38 which places the various outputs of A/D converters 47 into memory.

Referring to FIG. 5B, for the switching necessary for computing total velocity 74 in FIG. 1B, the $T_o$ pulse 168 sets flip-flop 178 output positive, which closes switch 176. This applies the fixed reference input to op-amp 188 until flip-flop 178 is reset by pulse $T_s$ along line 182 thereby opening switch 176. The $T_s$ pulse is generated by a conventional Schmitt trigger 184 which is triggered by the initial voltage from the strain gage assembly 64 at the moment the slack has been removed.

In computing the trajectory of a golf ball, the major input variables are the initial linear velocity components of the ball and the rotational rate of the ball. A method for determining the velocity components has been described. A method for determining rotational rate ("spin") is described hereinafter.

Spin is important because it creates lateral forces on the ball. Spin about a horizontal axis creates vertical forces on the ball, and spin about a vertical axis creates sideways forces on a ball. These sideways forces result in "hooking" or "slicing" of the ball. Spin about a horizontal axis may be estimated by using a nominal spin rate of approximately 3000 RPM. For a ball velocity of 70 meters per second, the variation in distance travelled by the ball varies perhaps only 2½ percent for spin rates from 2400 to over 5000 RPM. Thus, it may be considered unnecessary to correct the estimated distance by the spin about the horizontal axis.

The spin about the vertical axis, however, can produce curved sideways motion in the order of 10 to 20 percent of distance travelled. Therefore, spin rate ω about a vertical axis is preferably factored into the ballistic computation.

Figure 6:
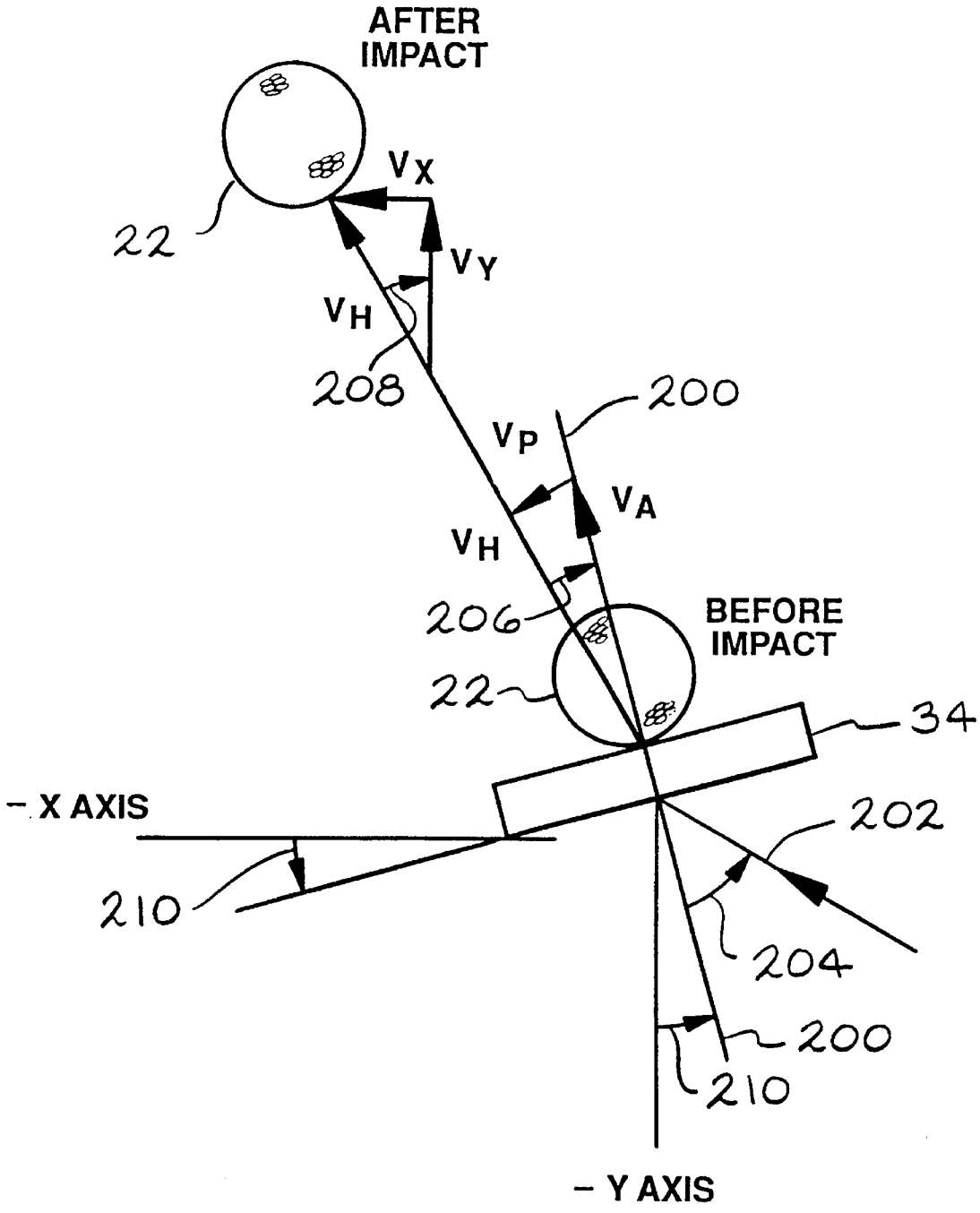
FIG. 6 is a diagrammic view illustrating the factors in golf ball spin.

In the horizontal plane, as seen in FIG. 6, the line 200 is perpendicular to a horizontal line in the club face. The quantities $V_P$ and $V_A$ are the components of horizontal ball velocity $V_H$ perpendicular and parallel respectively to line 200. If the club head 34 travels in a direction, illustrated at 202, perpendicular to the club face (i.e., when the angle illustrated at 204 is zero), the ball 22 will travel in a vertical plane which passes through line 200, and $V_P$ will be zero. From symmetry, the ball spin is zero for this case. If, however, the club head 34 is travelling in a direction wherein angle 204 is not equal to zero, the ball trajectory will deviate by an angle, illustrated at 206, from the plane defined by line 200. The sideways ball velocity $V_P$ corresponds to a linear momentum $m_B V_P$. This momentum is produced by frictional forces $F_P$ along the club face (i.e., perpendicular to line 200) producing an impulse $\int_o^{Ti} F_P\,dt$, where $T_i$ is the impact period between club and ball. This force acting on the face of the golf ball also produces a torque impulse on the ball about its center of mass. Thus, if R is the effective radius of the golf ball, $R\int_o^{Ti} F_P\,dt = Rm_B V_P$. But the torque impulse (i.e., $R\int_o^{Ti} F_p\,dt$) is equal to the change in angular momentum. Therefore, $R\ m_B\ V$ =change in angular momentum $=J_B w$, where w is the ball's angular velocity about its vertical axis and $J_B$ is the ball's angular moment of inertia about that axis. This thus allows the desired quantity w to be calculated.

Nominal values of $m_B$, R, and $J_B$ are well known from golf ball specifications. The quantity $V_P$ is found by resolving the known ball velocity $V_H$ into components with respect to line 200: $V_P = V_H \sin$ angle 206$= V_H \sin$(angle 208–angle 210). $V_H$ and angle 208 are determined from $V_x$ and $V_y$.

Figure 7A:
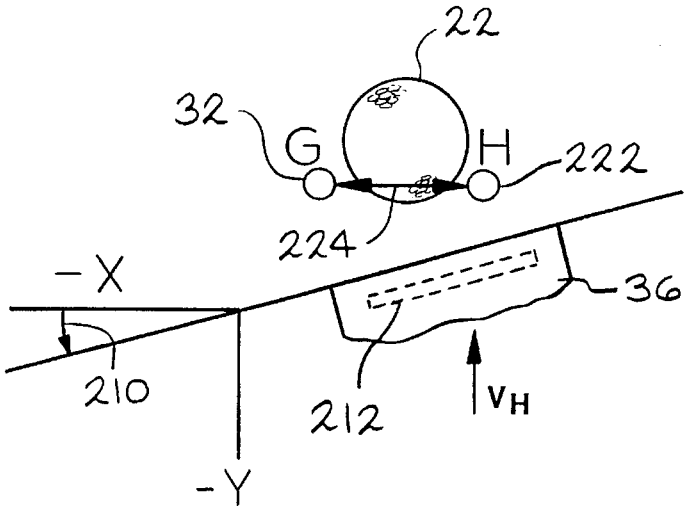
FIG. 7A is a top diagrammatic view illustrating a golf club and sensors for determining the angle of the ground facing surface of the golf club head during a swing.

Referring to FIG. 7A, the data needed to calculate angle 210 is obtained as follows. A narrow reflective strip 212 is placed on the surface, illustrated at 213, of the golf club head 34 which faces the ground during movement of the club 36 to impact a ball to be parallel to the face, illustrated at 215, of the golf club head 34 which contacts the ball. Two optical sensors 32 and 222 are referenced to ground, i.e., mounted underneath the playing surface on opposite sides of the tee 28 or ball location, "looking" upward, as shown in FIGS. 7A and 8. They are so placed that they would simultaneously "see" opposite end portions of the strip 212 passing overhead at the instant when the club face meets the ball, provided that the club face 215 (and therefore the strip) were perpendicular to the Y axis at that moment. If the club face 215 is not perpendicular to the Y axis, since the strip 212 is parallel to the club face, one or the other of the sensors will "see" the strip before the other. The time delay between the two events is equal to S sin (angle 210)/$V_c$, where S is the distance, illustrated at 224, between the optical sensors and $V_c$ is the club head velocity. It follows that $$\text{angle } 210 = \text{arc sin}\,\frac{(\text{time delay})\,(V_c)}{S}$$

Figure 7B:
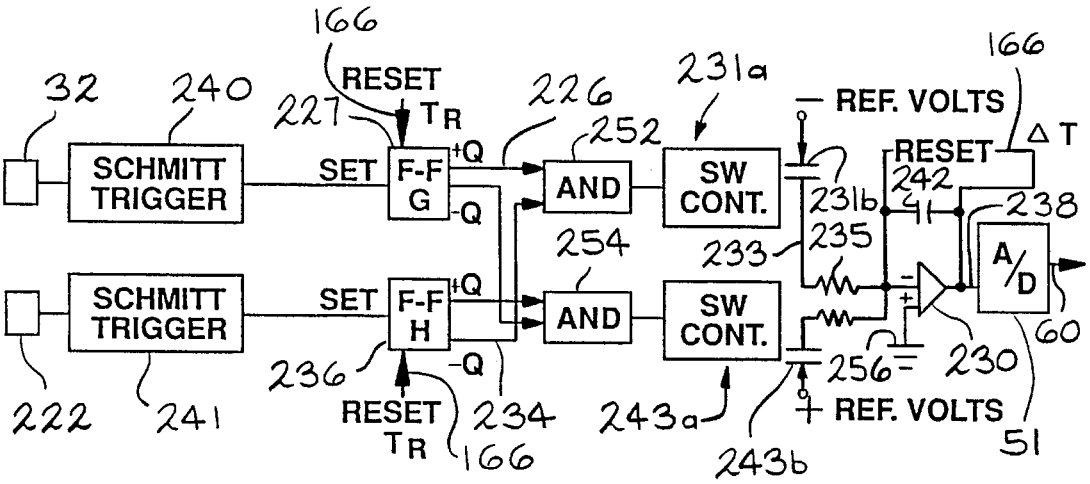
FIG. 7B is a schematic view of circuitry therefor.

The time delay is illustrated in FIGS. 1A, 1B and 7B as ΔT on line 229.

The reflective strip may typically be 1/16 inch wide and 3 inches long and composed of a material such as Reflexite AP1000 material manufactured by Reflexite corporation. The optical sensors may be similar to point-of-sale bar code scanners manufactured, for example, by Custom Sensors Inc. of Auburn, N.Y. The sensors may be spaced apart on the ground on opposite sides of the ball a distance of perhaps about one inch to thus sense the opposite end portions of the strip 212. The scanners each contains an IR (infra-red) emitting diode which illuminates the strip as it passes the optical axis of the scanner, and an IR diode which produces a current pulse proportional to the IR light reflected from the strip.

The processing of the pulses from the IR diodes is discussed below, followed by a description of the manner in which club head velocity is established.

Referring to FIG. 7B, the sensors 32 and 222 trigger conventional Schmitt triggers 240 and 241 respectively. The trigger outputs switch the outputs of their associated flip-flops 227 and 236 respectively. The positive output from flip-flop 227 and the negative output from flip-flop 236 are summed in AND gate 252 and the sum outputted to switch 231. The negative output from flip-flop 227 and the positive output from flip-flop 236 are summed in AND gate 254 and the sum outputted to switch 243. Assume, for example, that sensor 32 is actuated first. Then, the output Q from flip-flop 227 goes high (i.e., plus), illustrated at 226, closing switch 231, providing a voltage via line 233 containing resistor 235 to the negative terminal of ΔT integrator 230, which has feedback capacitor 242, and starting a positive ramp output, illustrated at 238, from the ΔT integrator 230 into the A/D converter 51. The positive terminal of the ΔT integrator is grounded as illustrated at 256. This ramp continues to increase until sensor 222 is activated, driving the output of flip-flop 236 negative, as illustrated at 234, thereby opening switch 231. The output voltage ΔT provided by A/D converter 51 is therefore proportional to the time between actuation of the sensors 32 and 222. It can be seen that the polarity of the ΔT voltage depends on which sensor is first actuated, i.e., if sensor 222 is actuated before sensor 32, then AND gate 254 closes switch 243. Reset of the ΔT integrator 230 is achieved by reset signal 166.

The club speed $V_c$ can be estimated since the ball speed in the horizontal plane, $V_H$, has been determined and the coefficient of restitution, e, is known (approximately 0.8 for a golf club/ball impact). From the law of the conservation of linear momentum, it can be shown that $V_c = ((1+K)/(1+e))V_H$ where K is the ratio of golf ball mass to club head mass.

Since angle 210 is much less than 1 radian and since sin (angle 210) is therefore approximately equal to angle 210, it follows that $$\text{angle } 210 \approx \frac{(1+K)\,(V_H)\,\Delta T}{(1+e)S}$$

With angle 210 now known, the ball spin rate may now be computed as previously discussed.

To enhance system performance three correction terms can be used with the previously described techniques for determining ball velocity. They are described below.

Figure 9:
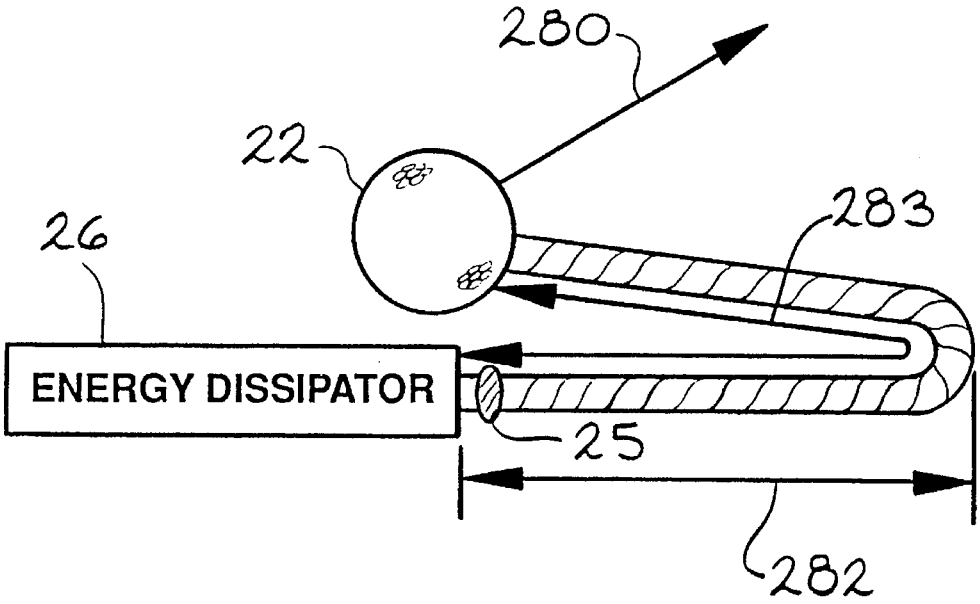
FIG. 9 is a diagrammatic side view illustrating tether placement for hitting a golf ball.

Firstly, the equation V=L/T., illustrated at 260, assumes a tether mass which is negligible. There is some slowing down of the ball because the ball must accelerate a portion of the tether to the ball velocity during the period when the slack is being removed. The exact fraction of the tether length accelerated depends on the placement of the tether prior to the ball being struck. In order to correct for the retardation of the ball by the tether mass, the ball total velocity 74 can more accurately be calculated as $$V = \frac{L}{KT_s},$$

where K is a constant depending on the tether mass and placement. Assume, for example, that the tether is placed as shown in FIG. 9 with the ball travelling in the direction illustrated at 280 after it is hit. For the tether placement shown, after the ball is struck, it begins accelerating a length L/2, illustrated at 282, of the tether to the velocity of the ball, a portion at a time. Since the momentum of the ball/tether system remains constant until the slack is removed, the velocity of the ball has been reduced at time $T_s$ to the initial velocity 74 multiplied by [ball mass/(ball mass +coupled tether mass)]. For a tether length L, illustrated at 283, of 2 feet of ⅛" diameter nylon rope, the coupled tether weight of 1 feet of rope, as shown in FIG. 9, may be perhaps 0.1 oz. and the ball weight may be perhaps 1.6 oz. Therefore, the ball velocity at time $T_s$ is reduced by a factor $$\frac{1.6}{1.6+0.1}$$

or 0.94. The average ball velocity during the time of slack removal may be reduced by perhaps only half this amount because the tether length accelerated to ball velocity varies from zero when the ball is first struck to L/2 at time $T_s$. Therefore, K in this example may be perhaps 0.97.

Figure 10:
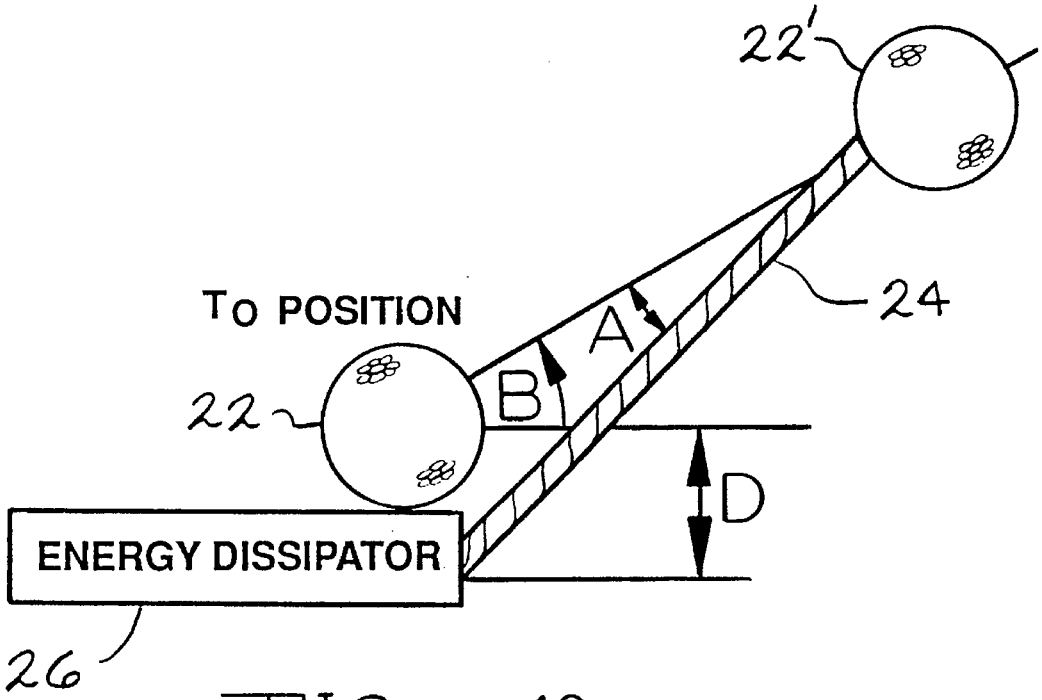
FIG. 10 is a diagrammatic side view illustrating slack removal in the tether after hitting of the golf ball.

Secondly, the ball cannot of necessity occupy the same position as does the "squeezer" 26. The squeezer 26 may, for example, be mounted, as shown in FIG. 10, directly below the initial position of the ball by a distance D. FIG. 10 also shows at 22' the position of the ball at the instant the slack has been removed. Because the tether is not co-linear with the line of ball travel, a downward force $F_D$ is exerted on the ball equal to $F_T$ sin A cos B, where $F_T$ is the force on the tether. If we assume angles A and B in FIG. 10 to be essentially constant during deceleration of the ball, after dividing both sides of the above equation by $m_B$, the change in the vertical velocity $$V_z=\frac{1}{m_B}\int_{Ts}^{Tm} F_T dt=\frac{\sin A\cos B}{m_B}\int_{Ts}^{Tm} F_T dt.$$

But $$\int_{Ts}^{Tm} F_T/m_B\, dt$$

is approximately equal to the initial ball momentum $m_B$ V. Therefore, the correction to $V_Z$ is approximately equal to $m_B$ sin A cos B V, where B is arc tan $V_z/V_y$ where $V_z$ and $V_y$ are the uncorrected velocities previously calculated. Angle A is approximately D/L, where L is the tether length.

Thirdly, the vertical distance D causes the distance L, which the ball must travel until removal of the slack, to be a function of D and the angle B. The distance L may be corrected by an amount ΔL, where ΔL=−D sin B.

Although the invention has been described in detail herein, it should be understood that the invention can be embodied otherwise without departing from the principles thereof, and such other embodiments are meant to come within the scope of the present invention as defined by the appended claims.

What is claimed is:

1. Golf practice apparatus comprising means for tethering a golf ball, means for dissipating kinetic energy of the golf ball when it is struck, means attached to said energy dissipation means for deriving an initial velocity vector of the golf ball in each of x, y, and z directions in a cartesian coordinate system over the period of time during which the kinetic energy is dissipated including means for measuring and time integrating force components measured in the x, y, and z directions during the period of time whereby the untethered trajectory of the golf ball may be computed.

2. Apparatus according to claim 1 further comprising means for determining i spin rate of the ball about a vertical axis of the ball.

3. Apparatus according to claim 2 further comprising means for computing and displaying diagnostic data for aiding a golfer to correct errors in the golfer's swing.

4. Apparatus according to claim 1 further comprising means for computing and displaying diagnostic data for aiding a golfer to correct errors in the golfer's swing.

5. Apparatus according to claim 1 further comprising means for determining an angle of a ball contact face of a golf club, measured about a vertical axis, relative to a vertical plane at a time of impact of the golf ball including at least two sensor means and means for comparing times at which reflections from a reflective strip on the club intercept said at least two sensor means respectively during movement of the club to impact the golf ball.

6. Apparatus according to claim 5 further comprising means for estimating from the ball contact face angle of the golf club and the initial velocity vectors of the golf ball an expected curvature of the golf ball flight.

7. Apparatus according to claim 1 wherein said velocity vector deriving means comprises a strain gage means for measuring the force components and outputting signals representative thereof, means for amplifying the force component signals, negative feedback integrator means for receiving and time integrating the signals, circuit means for connecting an input of said integrator means to an output of said amplifying means until an initial one of the force components is received, means for opening said circuit means during a period of time when the signals are being received thereby to effect cancellation of effects of offsets inherent in the strain gage means and amplifying means.

8. Golf practice apparatus comprising means for tethering a golf ball, means for dissipating kinetic energy of the golf ball when it is struck, means attached to said energy dissipation means for deriving total initial velocity of the golf ball and initial velocity vectors of the golf ball in two of x, y, and z directions in a cartesian coordinate system over the period of time during which the kinetic energy is dissipated including means for measuring and time integrating force components measured along directions respectively of said initial velocity vectors during the period of time and means for deriving from said derived initial velocity vectors and said derived total initial velocity an other initial velocity vector of the golf ball in an other of said x, y, and z directions whereby the untethered trajectory of the golf ball may be computed.

9. Apparatus according to claim 8 further comprising means for determining a spin rate of the ball about a vertical axis of the ball.

10. Apparatus according to claim 9 further comprising means for computing and displaying diagnostic data for aiding a golfer to correct errors in the golfer's swing.

11. Apparatus according to claim 8 further comprising means for computing and displaying diagnostic data for aiding a golfer to correct errors in the golfer's swing.

12. Apparatus according to claim 8 further comprising means for determining an angle of a ball contact face of a golf club, measured about a vertical axis, relative to a vertical plane at a time of impact of the golf ball including at least two sensor means and means for comparing times at which reflections from a line on the club intercept said at least two sensor means respectively during movement of the club to impact the golf ball.

13. Apparatus according to claim 12 further comprising means for estimating from the ball contact face angle of the golf club and initial velocity vectors of the golf ball an expected curvature of the golf ball flight.

14. Apparatus according to claim 8 wherein said velocity vector deriving means comprises a strain gage means for each of the two directions for measuring the respective force components and outputting signals representative thereof, means for amplifying the force component signals, negative feedback integrator means for receiving and time integrating the signals, circuit means for connecting an input of said integrator means to an output of said amplifying means until an initial one of the force components is received, means for opening said circuit means during a time when the signals are being received thereby to effect cancellation of effects of offsets inherent in the strain gage means and amplifying means.

15. Golf practice apparatus comprising a golf club having a head including a surface on said head for facing the ground during movement of the club to impact a golf ball and further including a golf ball contact face, a reflective strip on said facing surface which reflective strip is parallel to said ball contact face of said golf club, at least two sensor means disposable to detect reflections from said strip during movement of the club to impact a golf ball, means for comparing times at which the sensor means detect the reflections respectively for determining an angle of the ball contact face of the golf club, measured about a vertical axis, relative to a vertical plane at a time of impact of the golf ball, means for deriving initial velocity vectors of the golf ball in two horizontal directions in a cartesian coordinate system, and means for estimating, from the ball contact face angle of the golf club and initial velocity vectors of the golf ball in two horizontal directions in a cartesian coordinate system, a spin rate of the golf ball about a vertical axis of the ball and an expected curvature of the golf ball flight due to the ball spin rate.

* * * * *